US005269524A

United States Patent [19]

Womack

[11] Patent Number: 5,269,524

[45] Date of Patent: Dec. 14, 1993

[54] GAME BOARD WITH SUPPORT MECHANISM

[76] Inventor: Ellouise Womack, 1939 Linden, Memphis, Tenn. 38104

[21] Appl. No.: 796,869

[22] Filed: Nov. 25, 1991

[51] Int. Cl.[5] ..... A63F 9/10

[52] U.S. Cl. ..... 273/157 R; 273/285; 273/406

[58] Field of Search ..... 273/157 R, 285-287, 273/309; 434/419, 406, 413, 414, 422, 423, 432

[56] References Cited

U.S. PATENT DOCUMENTS

| | | | |
|---|---|---|---|
| D. 262,461 | 12/1981 | Holson | D19/26 |
| D. 302,830 | 8/1989 | Popat et al. | D9/26 |
| 643,731 | 2/1900 | Prosser et al. | 434/419 |
| 1,015,498 | 1/1912 | Kraus | 434/419 |
| 1,630,530 | 5/1927 | Fryer | 273/157 R |
| 1,941,558 | 1/1934 | Labbe | 273/157 R |
| 2,506,189 | 5/1950 | Abbridge | 273/157 R |
| 2,867,045 | 1/1959 | Millgate | 434/432 |
| 3,083,020 | 3/1963 | Terschak | 273/285 |
| 3,171,540 | 3/1965 | Douglas | 273/157 R |
| 3,433,485 | 3/1969 | Renn et al. | 273/157 R |
| 3,618,955 | 11/1971 | Barnes | 273/157 R |
| 3,974,576 | 8/1976 | Quinn, III | 273/157 R |
| 4,111,418 | 9/1978 | DeMent, Jr. | 273/285 |
| 4,486,018 | 12/1984 | Keller, Jr. | 273/157 R |
| 4,502,658 | 3/1985 | Wirt et al. | 273/285 |
| 4,886,231 | 12/1989 | Doerksen | 248/455 |

*Primary Examiner*—V. Millin
*Assistant Examiner*—Steven B. Wong

[57] ABSTRACT

A folding magnetic, reusable, game board, useful as a puzzle board and in combination with a jigsaw puzzle and associated instructional puzzle placard, having first and second foldable components and a non-foldable component, a magnetic playing surface for engaging magnetically attractive playing pieces, and a non-playing surface opposite the playing surface. A support system with an elongated member, and pivotal leg frame comprised of a pair of braced leg members useable to incline the game board above the horizontal plane upon which it rests. A cooperating closure mechanism with a first closure tab associated with the first foldable component, and a second closure tab associated with the second foldable component engageable with one another to maintain the game board in a closed position.

18 Claims, 3 Drawing Sheets

GAME BOARD WITH SUPPORT MECHANISM

BACKGROUND OF THE INVENTION

1. Field of the Invention

The present invention relates generally to games, puzzles and learning aids with foldable play boards and support mechanisms, and more particularly to such articles having playing surfaces that hold the playing pieces useable in conjunction therewith.

2. Description of the Prior Art

Many games, toys, puzzles and learning aids employ playing or work boards, hereinafter collectively referred to as "game boards." Some game boards are foldable and others are modular, but virtually all have a playing surface associated therewith.

Game boards with metallic playing surfaces have proven particularly useful with magnetic playing pieces. An example of a game board having a metallic playing surface is found in U.S. Pat. No. 3,093,919 granted to Holtz.

Some prior art game boards include separate support mechanisms which are used to incline the playing surface to a preset angle above the horizontal upon which the game board rests. U.S. Pat. No. 4,502,658 granted to Wirt et al., U.S. Pat. No. 3,083,020 granted to Terschak, and U.S. Pat. No. 1,674,095 granted to Buedingen, are examples of such game boards.

Prior art game boards of the above-described type, particularly those used in conjunction with jigsaw puzzles, have not provided the user a means to effectively transport the game board without displacing the playing pieces positioned on the playing surface.

Heretofore, a foldable, transportable game board of the type having both an attractive playing surface for holding the playing pieces, a means for maintaining the playing pieces on the playing surface when the game board is transported, and a support mechanism for selectively varying the angle at which the game board may stand freely has not been invented.

SUMMARY OF THE INVENTION

The present invention is directed to a self-supporting game board for holding game playing or jigsaw puzzle pieces and a corresponding instructional puzzle placard. The invention comprises articulating and non-articulating game board components, a playing surface, a non-playing surface, and a support mechanism.

The articulating portions of the game board are contiguous with the non-articulating portion, and pivot outwardly from a closed position, and away from the integral non-articulating portion, to an open position. When open, the playing surface spans the articulating and non-articulating portions.

The playing surface, a portion of the non-playing surface, an area of the puzzle placard and the backs of the puzzle or game pieces used in combination with the invention, are treated, covered or impregnated with adhesive or magnetically attractive material. When the puzzle pieces and placard are positioned on the playing surface and attractive portion of the non-playing surface, respectively, the playing pieces and placard adhere thereto.

The support mechanism for the game board enables the user to incline the playing surface to an ergonomic angle from about 0–90 degrees relative to the table or horizontal surface upon which it rests, wherein the support mechanism comprises an elongated support member rigidly attached to the non-playing surface and a leg frame.

The leg frame is comprised of a pair of legs, each having one end pivotally connected to the elongated support member. The elongated member and legs enable the game board not only to be inclined, but free-standing as well. A brace member may be attached to and between the free end of the legs in order that they are kept in parallel alignment with one another. Optionally, a non-skid or non-slip material can be applied to the free ends of the legs to minimize sliding of the game board while playing.

A cooperating closure tab or buckle system mounted to the non-playing surface enables the game board to be securely fastened in a closed position. When closed and fastened, a storage cavity is formed within the folded game board. The puzzle or playing pieces adhering to the playing surface prior to closing the game board, continue to remain in contact with the playing surface after the game board is closed. At the user's option, the instructional puzzle placard may also be stored within the cavity.

DETAILED DESCRIPTION OF THE PREFERRED EMBODIMENTS

Figure 1:
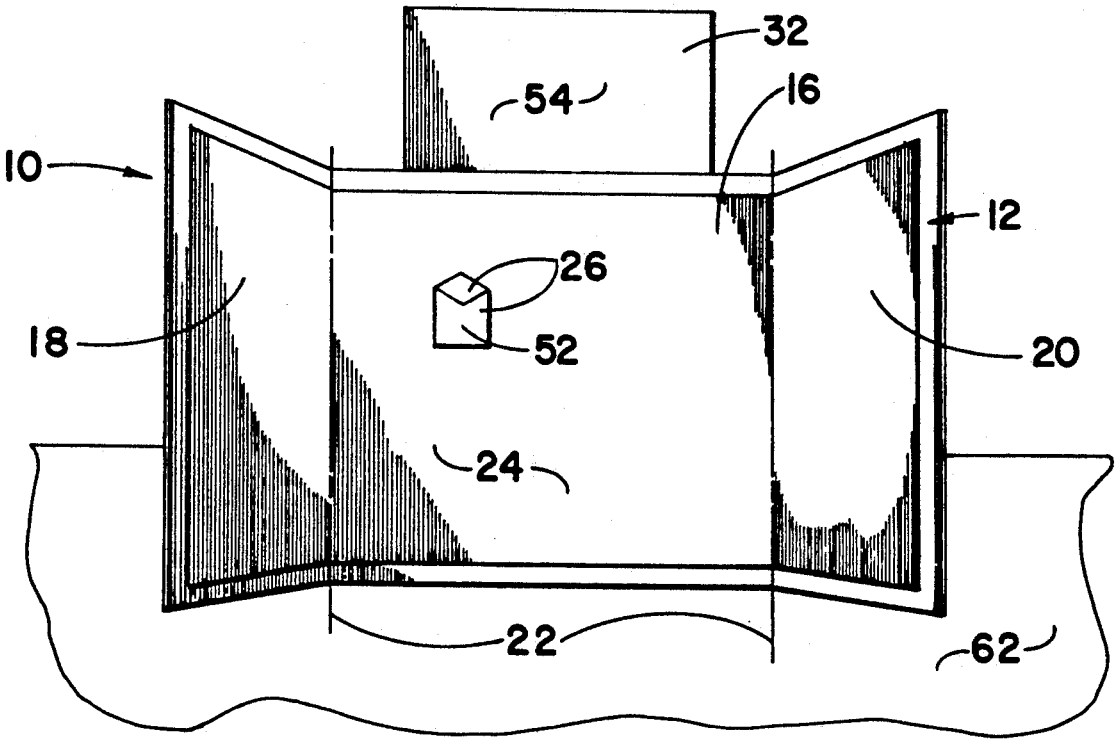
FIG. 1 is a front elevational perspective view of the game board in a partially open, inclined position, and resting on a support surface.
Figure 2:
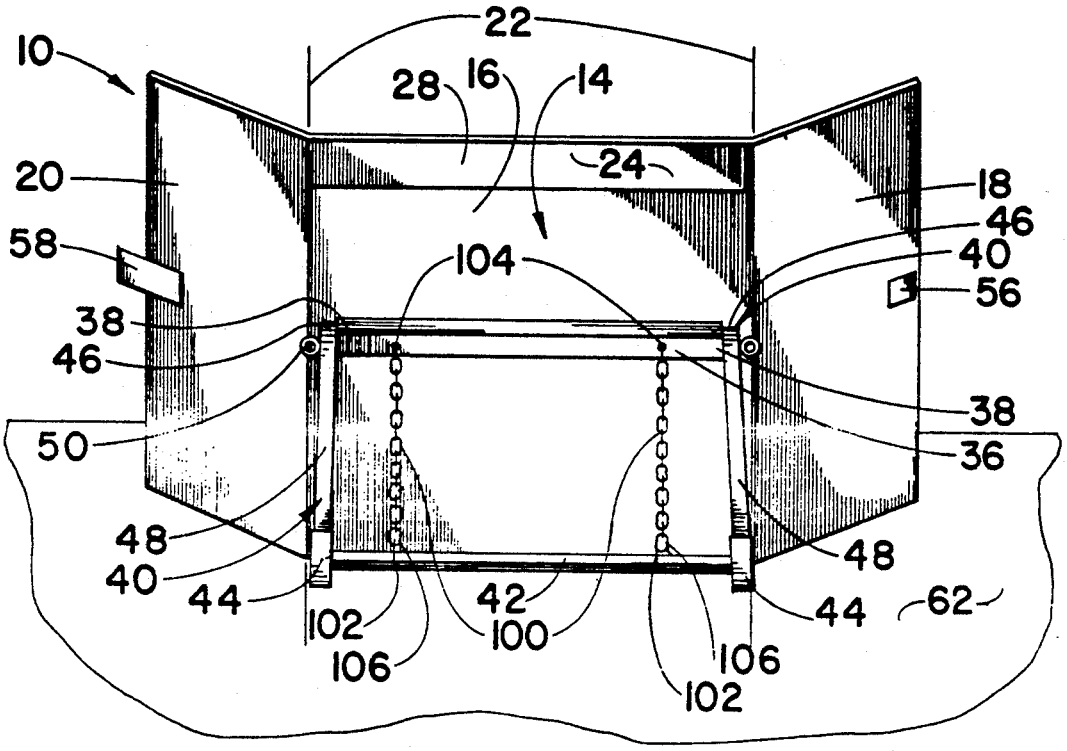
FIG. 2 is a rear elevational perspective view of the game board in a partially open position, and supported at an inclined angle by an alternate embodiment of the support mechanism.

As shown in FIGS. 1 and 2, the inventive game board designated generally by the reference numeral 10 has a playing surface 12, a non-playing surface 14, a non-articulating component 16, and left and right articulating components 18 and 20, respectively, which articulate about imaginary lines 22. It is appreciated that the articulating portion of the display device may comprise a single articulating component having an associated single imaginary line of articulation.

As best seen in FIG. 1, playing surface 12 of the preferred embodiment is substantially covered with an attractive magnetic sheeting material 24, so that the magnetically attractive playing or puzzle pieces 26, used in combination with the present invention, adhere thereto.

Similarly, in FIG. 2 a placard retaining strip 28 associated with the non-playing surface 14 of the non-articulating component 16 of the game board 10, is shown also substantially covered with a magnetic sheeting material 24, so that a magnetically attractive puzzle placard 32 can be held in place by adhering thereto (FIG. 1).

It will become apparent to those skilled in the art that in place of the magnetic or magnetically attractive sheeting material described above, any suitable combination of materials may be used, so as long as the playing pieces adhere to the playing surface and the placard adheres to the placard retaining strip. Examples of such alternate combinations are hook and loop material, adhesives, and non-magnetic pliable plastics or polymers that frictionally adhere to one another.

Figure 4:
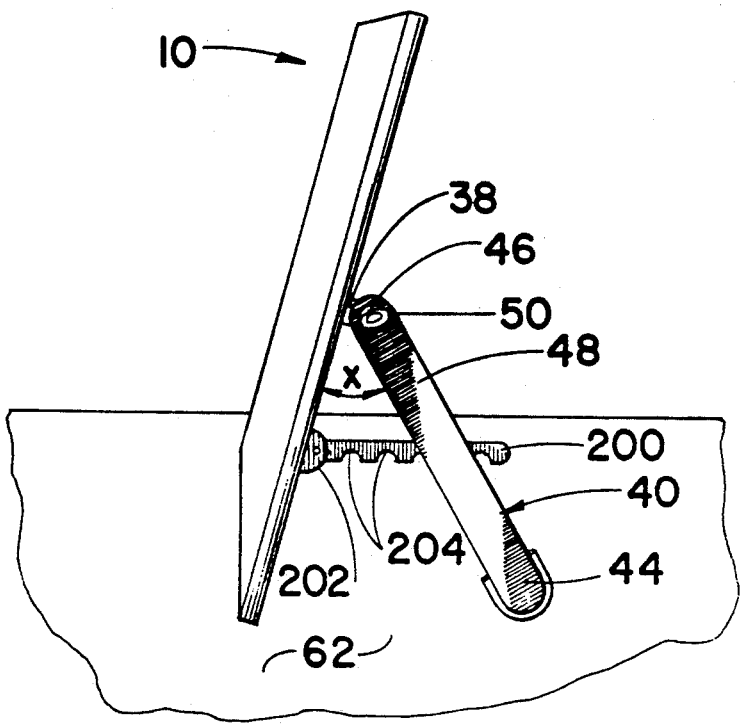
FIG. 4 is a side elevational perspective view of the right side of the game board of FIG. 3, and resting on a support surface at an incline supported by yet another embodiment of the support mechanism.
Figure 5:
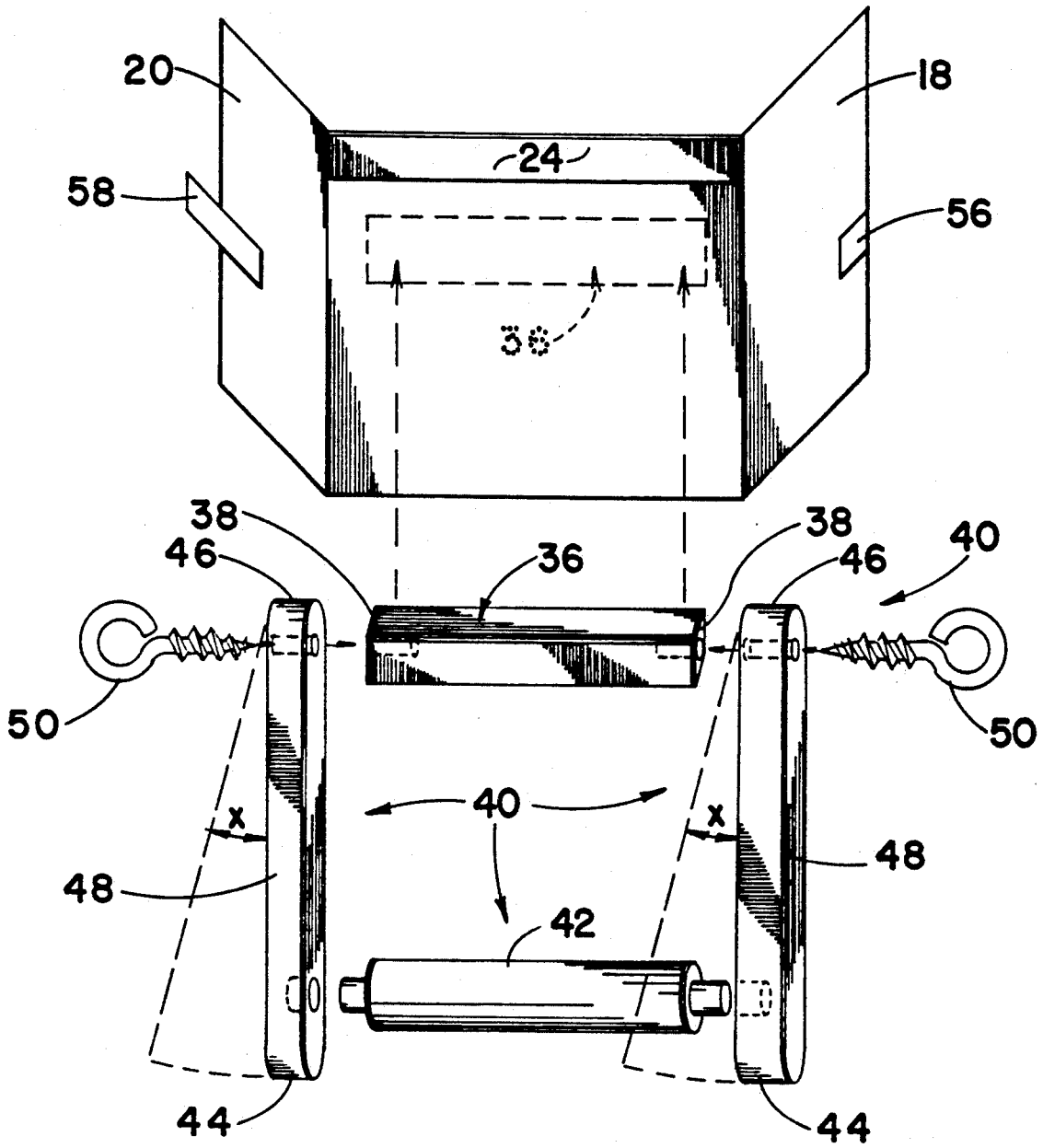
FIG. 5 is a rear perspective view of the game board with the support mechanism removed therefrom and shown in exploded format.

Best shown in FIGS. 2 and 5, is the support mechanism designated generally by the reference numeral 40. Support mechanism 40 comprises an elongated crossbar member 36 having ends 38, and a pair of legs 48. In the preferred embodiment, a brace member 42 connects the free ends 44, opposite the pinned ends 46, of the legs 48 to one another so as to maintain them in parallel alignment one to another. Legs 48 are pivotally attached to the elongated crossbar member 36 by passing eyelet screws 50 through the pinned ends 46 of the legs 48 and into crossbar ends 38 (FIG. 5). When tightened, the eyelet screws keep the pivot angle X (FIG. 4) constant.

An alternate embodiment of the present invention incorporates a threaded or partially threaded rod or pin configuration (not shown) contained within, and protruding from the ends 38 of the elongated member 36. In this embodiment, the legs are pivotally attached to the elongated member by passing the ends portions of the threaded rod (not shown) through the pinned ends 46 of the legs and tightening wing nuts (not shown) thereon, so to perform substantially the same function as the eyelet screws.

Useful in conjunction with the eyelet screws 50 of the preferred embodiment or the threaded rod configuration discussed above, are optional support chains 100 (FIG. 2). Chains 100 have grapling hook ends 102 and elongated member engaging ends 104. Grapling hooks 102 are formed to grasp the grasp brace member 42. In this position, the separation distance between the free ends 44 of legs 48 and the non-playing surface 14, as well as angle X (not visible in FIG. 2) are kept constant.

It will become apparent to one skilled in the art that ends 104 of chains 100 may be anchored directly to the non-playing surface at suitable locations thereon, so long as substantially the same leg constraining function is accomplished.

Shown in FIG. 4 is another alternate embodiment of the support mechanism associated with the present invention. Slotted bar 200 is pivotally attached to the non-playing surface 14 by pivot 202. Bar 200 has locking notches 204 of sufficient size to correspond to the outside diameter of the brace member 42 (not visible).

When the legs 48 are pivoted away from the non-playing surface 14, and any one of the notches 204 is allowed to rest on or engage the brace member 42, the game board may stand freely.

MODE OF OPERATION

The inventive game board is especially suited for use in combination with a jigsaw puzzle and corresponding puzzle placard.

To begin play with the preferred embodiment of the invention, the user separates the cooperating closure tabs 56 and 58, and folds back the left and right articulating components 18 and 20 to an open position as best seen in FIG. 1.

As shown in FIGS. 1 and 2, and as described above, puzzle pieces 26 and placard 32 having portrait surfaces 52 and 54, respectively, may then be placed against the playing surface 12 and retaining strip 28. The magnetic sheeting 24, also applied to at least a portion of the backs of the playing pieces and front of the puzzle placard, enable the playing pieces and placard to remain in their installed positions until removed by the user.

Of course, magnetic sheeting 24 can be replaced with a suitable combination of materials which when acting together, such as when the backs of the puzzle pieces contact the playing surface they adhere thereto. Examples of such combination of materials is hook and loop material, adhesives, plastics or polymers that adhere to one another when pressed together, or the like.

At any time, but preferably before play has begun, the user pivots the legs 48 of the support frame 40 away from the non-playing surface 14 creating an angle X between the legs 48 and the non-playing surface 14 of the non-articulating component 16. With the legs 48 of the frame structure 40 pivoted away from the display device, pivot screws 50, or the wing nuts of the alternate embodiment (not shown), are tightened to insure that angle X remains constant. The user may then place the entire display device on a table or other work surface 62 in a free-standing, upright position. It is appreciated that a change in the angle X will facilitate a corresponding change in the incline of the device.

When finished with a particular play session, the user simply collapses the support frame 40 in essentially the reverse process as that described above. The user may now remove the puzzle placard 32 from the placard retaining strip 28, and place it against the playing surface 12 adjacent the non-articulating component 16, without disturbing the positions of the playing pieces 26 already adhering to the magnetic sheeting 24.

Figure 3:
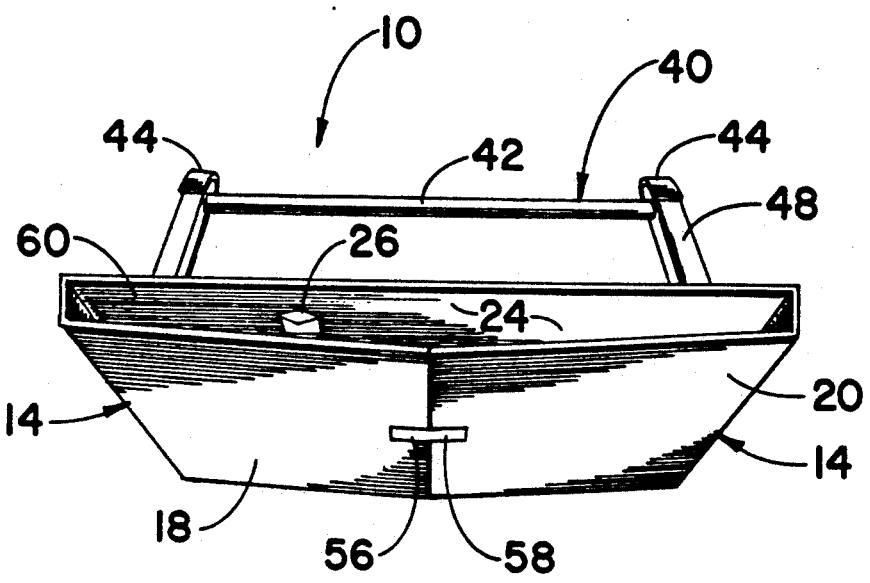
FIG. 3 is a top perspective view of the display device in a substantially closed position, and raised to an incline supported by another of the alternate embodiments of the support mechanism.

Left and right articulating components 18 and 20 are then folded inward toward the non-articulating component 16, creating a storage cavity 60 (FIG. 3) which retains the puzzle pieces 26 and placard 32.

Fastening the cooperating closure tabs 56 and 58 insures that an abutting compressive force from the articulating components 18 and 20 is applied to the puzzle pieces and placard contained within the cavity 60. In this fashion, the inventive display device may be transported as a unit, without undue concern that the puzzle pieces will become disengaged from the playing surface.

It will become apparent to those skilled in the art that various modifications may be made within the spirit and scope of the present invention, and the appended claims. Thus, it is intended that the present invention cover the modifications and variations of this invention provided they come within the scope of the appended claims and their equivalents.

What is claimed is:

1. A game board comprising:

a playing surface and a non-playing surface;

a support means attached to said non-playing surface for inclining said game board relative to the plane upon which it rests;

a first portion, and at least one articulating portion rotatably joined with said first portion enabling the game board to be opened and closed;

said playing surface is contiguous with and disposed on said first portion and said at least one articulating portion;

said support means further comprising a leg frame and a pivot means for pivotally connecting said leg frame to said game board; and a jigsaw puzzle comprised of a plurality of puzzle pieces having a portrait surface and a back surface opposite said portrait surface, said back surface and said playing surface are configured such that said back surface is engageable with and adheres to said playing surface of said game board.

2. The game board of claim 1, wherein:

said back surface of said jigsaw puzzle and said playing surface are magnetic.

3. The game board of claim 1, wherein said pivot means further comprises:

a tightening means for maintaining said leg frame at a selectable angle to said non-playing surface.

4. The game board of claim 1, further comprising:

a cooperating closure means attached to said non-playing surface of said game board for maintaining said game board in a closed position.

5. The game board of claim 1, further comprising:

a placard holding means attached to said non-playing surface of said game board for holding a placard.

6. The game board of claim 1 further comprising:

said leg frame comprises at least two legs and a brace means for interconnection of said legs, and grasping means engageable with said brace means for maintaining said leg frame a preselected separation distance from said non-playing surface.

7. A game board comprising:

a playing surface and a non-playing surface;

a support means for inclining said game board relative to the plane upon which it rests;

said support means further comprises an elongated member connected to said non-playing surface, and a leg frame pivotally connected to said elongated member;

said game board further comprising a first portion, and at least one articulating portion adjoining said first portion, and wherein said playing surface is contiguous with and disposed on both said first portion and said at least one articulating portion;

a jigsaw puzzle comprised of a plurality of puzzle pieces each having a portrait surface and a back surface opposite said portrait surface, said back surface and said playing surface are configured such that said back surface is engageable with and adheres to said playing surface of said game board.

8. The game board of claim 7 further comprising:

a closure means associated with said at least one articulating component of said game board for maintaining said articulating component in a closed position.

9. The game board of claim 7, further comprising:

a placard retaining means attached to said non-playing surface of said game board for holding a placard, and an instructional puzzle placard engageable with said placard retaining means.

10. The game board of claim 7 wherein:

said leg frame comprises at least two legs and a brace means for interconnection of said at least two legs.

11. The game board of claim 10 further comprising a holding means engageable with said brace means for maintaining said legs a preselected angle away from said non-playing surface.

12. A jigsaw puzzle system comprising:

a game board having a magnetic playing surface and a non-playing surface;

said game board further comprising a left articulating portion, a right articulating portion, and a central non-articulating portion situated between and adjoining said left and said right articulating portions, and wherein said playing surface is contiguous with and disposed on said left and right articulating portions and said non-articulating portion;

a support means;

a storage means formed between the left and right articulating and central non-articulating portions of the game board when the articulating portions are in the closed position for storing articles therein;

a placard holding means attached to said non-playing surface of said game board for holding a placard; and a jigsaw puzzle having a portrait surface and a magnetic surface opposite said portrait surface for engagement with said playing surface of said game board.

13. The game board of claim 12, wherein said support fram further comprises:

an elongated member, at least two legs connected to said elongated member and a brance means for maintaining said at least two legs in a relative alignment with one another.

14. The game board of claim 13, wherein said support frame further comprises:

a pivot means for pivotally attaching said at least two legs to said elongated member.

15. The jigsaw puzzle system of claim 14 further comprising:

a tightening means associated with said pivot means for securing said game board at an incline relative to the plane upon which it rests.

16. The game board of claim 34 further comprising:

a closure means associated with said articulating component of said game board for maintaining said articulating component in a closed position.

17. The jigsaw puzzle system of claim 16, further comprising:

a first cooperating closure tab attached to the non-playing surface of said left articulating portion of said game board; and a second cooperating closure tab attached to the non-playing surface of said right articulating portion of said game board and engageable with said first cooperating closure tab to close the game board.

18. The jigsaw puzzle system of claim 12, further comprising:

a puzzle placard engageable with said placard holding means.

* * * * *